US006554510B1

(12) United States Patent
Hayashi et al.

(10) Patent No.: US 6,554,510 B1
(45) Date of Patent: Apr. 29, 2003

(54) PRINTING AID, ASSEMBLY JIG THEREFOR, AND RECORDING DEVICE

(75) Inventors: Takayuki Hayashi, Shimosuwa-machi (JP); Nobuaki Nagae, Chino (JP); Hiroyuki Kusumoto, Suwa (JP); Noriyuki Komatsu, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/787,733

(22) PCT Filed: Jun. 9, 2000

(86) PCT No.: PCT/JP00/03798

§ 371 (c)(1),
(2), (4) Date: Mar. 20, 2001

(87) PCT Pub. No.: WO01/07263

PCT Pub. Date: Feb. 1, 2001

(30) Foreign Application Priority Data

Jul. 23, 1999 (JP) ..... 11-209315

(51) Int. Cl.[7] ..... B41J 13/26; B41J 13/32
(52) U.S. Cl. ..... 400/578; 101/44
(58) Field of Search ..... 400/521, 522, 400/622, 578; 101/44; 428/84, 131, 134, 136, 192; 229/314, 69; 269/287, 288

(56) References Cited

U.S. PATENT DOCUMENTS

| | | | | | |
|---|---|---|---|---|---|
| 1,799,374 | A | * | 4/1931 | Hurley | 101/369 |
| 4,133,613 | A | | 1/1979 | Webster | 400/616.3 |
| 4,487,645 | A | | 12/1984 | Weston | 156/157 |
| 4,636,099 | A | * | 1/1987 | Goldstone | 229/68.1 |
| 4,790,475 | A | * | 12/1988 | Griffin | 206/820 |
| 5,008,700 | A | * | 4/1991 | Okamoto | 355/401 |
| 5,456,169 | A | | 10/1995 | Robwetter et al. | 101/35 |
| 6,158,909 | A | * | 12/2000 | McCue et al. | 347/104 |

FOREIGN PATENT DOCUMENTS

| | | | | |
|---|---|---|---|---|
| DE | 1 561 246 | | 3/1970 | |
| GB | 2 092 994 | | 8/1982 | |
| JP | 58-147059 | | 10/1983 | |
| JP | 59-209167 | | 11/1984 | |
| JP | 62-70944 | | 5/1987 | |
| JP | 62-73952 | | 5/1987 | |
| JP | 04239672 | A * | 8/1992 | B41J/13/10 |
| JP | 6-297788 | | 10/1994 | |
| JP | 9-11562 | | 1/1997 | |
| JP | 11254657 | A * | 9/1999 | B41J/2/01 |

OTHER PUBLICATIONS

Tucker, Archie J., "Slide Adapter," Apr. 1974, Defensive Publication, United States Patent Office, T921,013.*

* cited by examiner

*Primary Examiner*—Daniel J. Colilla
(74) *Attorney, Agent, or Firm*—Michael T. Gabrik

(57) ABSTRACT

A printing aid includes a printing position-determining member 22 for determining a position of a material to be printed 30 on a printing position of a printer device, and a placement member for material to be printed 21 for placing the material to be printed at a portion corresponding to the printing position determined by the printing position-determining member. This makes it possible to print on various types of materials to be printed with the printer device.

21 Claims, 10 Drawing Sheets

PRIOR ART

PRINTING AID, ASSEMBLY JIG THEREFOR, AND RECORDING DEVICE

TECHNICAL FIELD

The present invention relates to a printing aid which is used when printing is performed on a material to be printed by a recording device, to an assembly jig therefor, and to a recording device having the printing aid.

BACKGROUND ART

Hitherto, a printer device, in particular, a so-called personal use printer device privately used by an individual person at home has been, for example, as shown in FIG. 12.

That is, a printer device 1 includes a printer body 1*b*, and a stage 1*a*, which is connected to the printer body 1*b* and which places thereon, for example, a paper, which is a material to be printed.

When a user tries to print characters or the like on a paper, the paper is placed on the stage 1*a*, and operation sections and the like provided in front of the printer body 1*b* are operated to start printing.

When printing of the printer device 1 is started, the paper placed on the stage 1*a* is guided by a feed roller (not shown) provided in the printer body 1*b* into the printer body 1*b*.

In this case, an angle shown in FIG. 12 is provided to a connecting part between the stage 1*a* and the inside of the printer body 1*b*. This is intended to allow the feed roller of the printer body 1*b* to easily hold the paper because the paper placed on the stage 1*a* is positioned in a direction to approach the feed roller of the printer body 1*b* by its own weight.

Therefore, when the paper placed on the stage 1*a* is guided by the feed roller of the printer body 1*b* into the printer body 1*b*, the paper is in a bent state.

In this way, the paper guided to the inside of the printer body 1*b* is guided to a printing position by the feed roller. Since a printer head (not shown) is provided at the printing position, characters and the like can be printed on the paper by ejecting ink contained in the printer head from a nozzle.

The thus-printed paper is discharged by a discharge roller (not shown) provided in the printer body 1*b* toward a discharge pad 1*c*, is placed on the discharge pad 1*c*, and is then stopped. In this state, the user receives a printed paper from the discharge pad 1*c*.

Incidentally, in the printer device 1 as described above, printing cannot be performed on a material other than the paper, for example, on a dial of a timepiece, which is relatively small, hard, and thick.

In consideration of the above point, the present invention has as its object to provide a printing aid which makes it possible to print on various types of materials to be printed by a recording device, such as a printer device, to provide an assembly jig therefor, and to provide a printer device having the printing aid.

DISCLOSURE OF INVENTION

The above object is achieved by a printing jig according to one aspect of the invention including a printing position-determining member for determining a position of a material to be printed on a printing position of a recording device, and a placement member for material to be printed for placing the material to be printed at a portion corresponding to the printing position determined by the printing position-determining member.

Since the printing jig includes a printing position-determining member for determining a position of a material to be printed on a printing position of a recording device, and a placement member for material to be printed for placing the material to be printed at a portion corresponding to the printing position determined by the printing position-determining member, if the material to be printed is placed on the placement member for material to be printed, the material to be printed can be positioned at the printing position by the printing position-determining member.

Therefore, printing can be performed regardless of the size of the material to be printed.

According to another aspect of the invention, the printing position-determining member is formed of a base material having flexibility.

Since the printing position-determining member is formed of a base material having flexibility, the base material having flexibility is guided to a guide section of the recording device while being bent.

Therefore, even if the material to be printed is hard and is not bent, the base material having flexibility is bent instead of the material to be printed, and is correctly guided into the recording device.

According to another aspect of the invention, the printing position-determining member is provided with a printing direction-indicating part for indicating a printing direction.

Since the printing position-determining member is provided with a printing direction-indicating part for indicating a printing direction, a user does not make a mistake in the printing direction.

According to another aspect of the invention, the printing direction-indicating part is formed by an arrow and/or a cutout.

Since the printing direction-indicating part is formed by an arrow and/or a cutout, the user does not make a mistake in the printing direction of the material to be printed by confirming the arrow and/or the cutout.

According to another aspect of the invention, the material to be printed forms a dial of a timepiece, the dial of the timepiece is provided with a mounting pin, and the placement member for material to be printed is formed with a hole for receiving the pin.

Since the material to be printed forms a dial of a timepiece, the dial of the timepiece is provided with a mounting pin, and the placement member for material to be printed is formed with a hole for receiving the pin, the pin for mounting the dial of the timepiece, which is the material to be printed, can be arranged in the placement member for material to be printed.

According to another aspect of the invention, the placement member for material to be printed is provided with a fixing part for fixing the material to be printed.

Since the placement member for material to be printed is provided with a fixing part for fixing the material to be printed, the material to be printed does not shift on the placement member for material to be printed, and is not removed from the placement member for material to be, printed.

According to another aspect of the invention, the placement member for material to be printed is provided with an ink-collecting part for collecting ink ejected from the recording device.

Since the placement member for material to be printed is provided with an ink-collecting part for collecting ink of the recording device, unnecessary ink is collected in the ink-collecting part when the material to be printed is printed. Therefore, printing accuracy of the material to be printed is improved.

According to another aspect of the invention, the placement member for material to be printed is formed with a member for absorbing ink ejected from the recording device.

Since the placement member for material to be printed is formed with a member for absorbing ink ejected from the recording device, unnecessary ink is absorbed by the member for absorbing the ink ejected from the recording device when the material to be printed is printed. Therefore, printing accuracy of the material to be printed is further improved.

According to another aspect of the invention, the placement member for material to be printed is provided with a detaching recess for detaching the material to be printed.

Since the placement member for material to be printed is provided with a detaching recess for detaching the material to be printed, the user can easily detach the material to be printed using the detaching recess.

The above object is achieved by an assembly jig for a printing aid according to another aspect of the invention, including a storage section for storing a printing position-determining member, a processing section for processing the printing position-determining member into a required size, and a mounting opening for mounting a placement member for material to be printed having the material to be printed placed thereon at a predetermined position of the printing position-determining member.

According to this aspect of the invention, the printing position-determining member is stored in the storage section, and the printing position-determining member can be processed by the processing section into a required size. In addition, the user uses the mounting opening, whereby the printing member placement member can be accurately mounted to the printing position-determining member.

According to another aspect of the invention, the mounting opening is provided with a setting recess which corresponds to a holder for holding the placement member for material to be printed and sets up the placement member for material to be printed on the printing position-determining member.

Since the mounting opening is provided with a setting recess which corresponds to a holder for holding the placement member for material to be printed and sets up the placement member for material to be printed on the printing position-determining member, the user uses the setting recess, whereby the placement member for material to be printed can be easily set to the printing position-determining member.

The above object is achieved by a recording device according to another aspect of the invention, including a recording device body, a feed section for pulling in an object to a printing position in the recording device body, and a discharge section for discharging the object from the recording device body, wherein the object is a printing aid having a printing position-determining member for determining a position of a material to be printed on a printing position in the recording device, and a placement member for material to be printed for placing the material to be printed at a portion corresponding to the printing position determined by the printing position-determining member.

According to this aspect of the invention, the object is a printing aid having a printing position-determining member for determining a position of a material to be printed on a printing position in the recording device, and a placement member for material to be printed for placing the material to be printed at a portion corresponding to the printing position determined by the printing position-determining member. Therefore, if the material to be printed is placed on the placement member for material to be printed, the printing member is positioned at a printing position by the printing position-determining member. For this reason, the material to be printed can be printed in a state of being accurately positioned regardless of the size and the like.

BRIEF DESCRIPTION OF THE DRAWINGS

FIG. 10 is a schematic sectional view showing the state where the dial-making jig is moved in a discharge direction by a discharge roller, and the like.

BEST MODE FOR CARRYING OUT THE INVENTION

The preferred embodiment of this invention will now be described in detail with reference to FIGS. 1 to 11.

The present invention will be explained below in its preferred forms, and suitable technical limitations are thus imposed on the embodiments. However, it is to be understood that the invention is not limited to the specific forms of the embodiments thereof unless otherwise specified in the following description.

Figure 1:
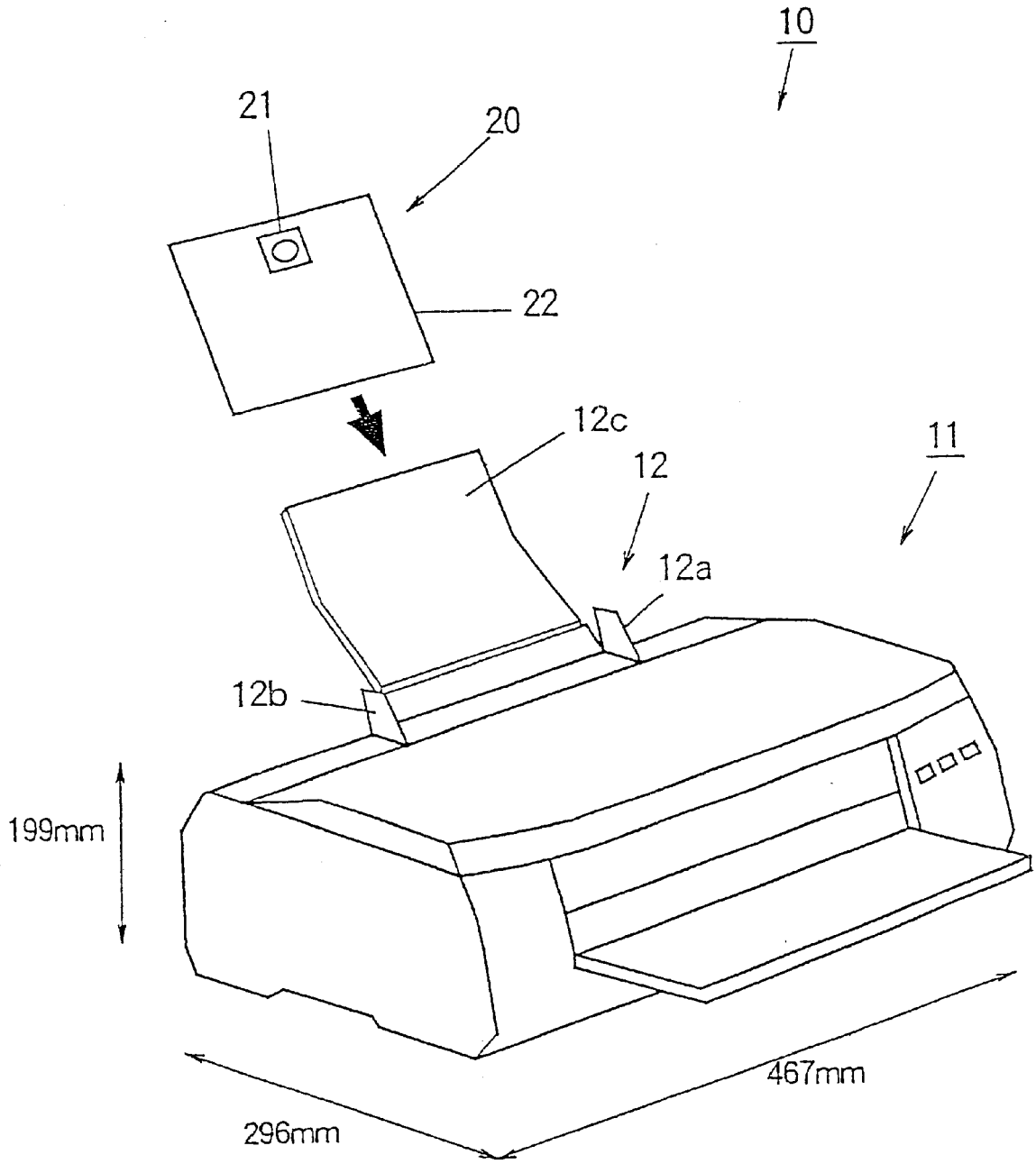
FIG. 1 is a schematic perspective view showing the configuration of a dial printing machine according to an embodiment of the present invention.

FIG. 1 is a view showing a dial printer 10 having a dial-making jig 20, which is a printing aid according to this embodiment, and a dial printing machine body 11 which is a printer body as a recording device.

As shown in FIG. 1, the dial-making jig 20 includes, for example, a pallet 21, which is a placement member for material to be printed for placing a material to be printed, for example, a dial 30 of a timepiece, and a film 22, which is a flexible film, including the pallet 21 at a predetermined position.

In addition, the dial printing machine body 11 is first provided with an ASF (Auto Sheet Feeder) section 12, which is a feeding section by which a user places the dial-making jig 20.

Figure 2:
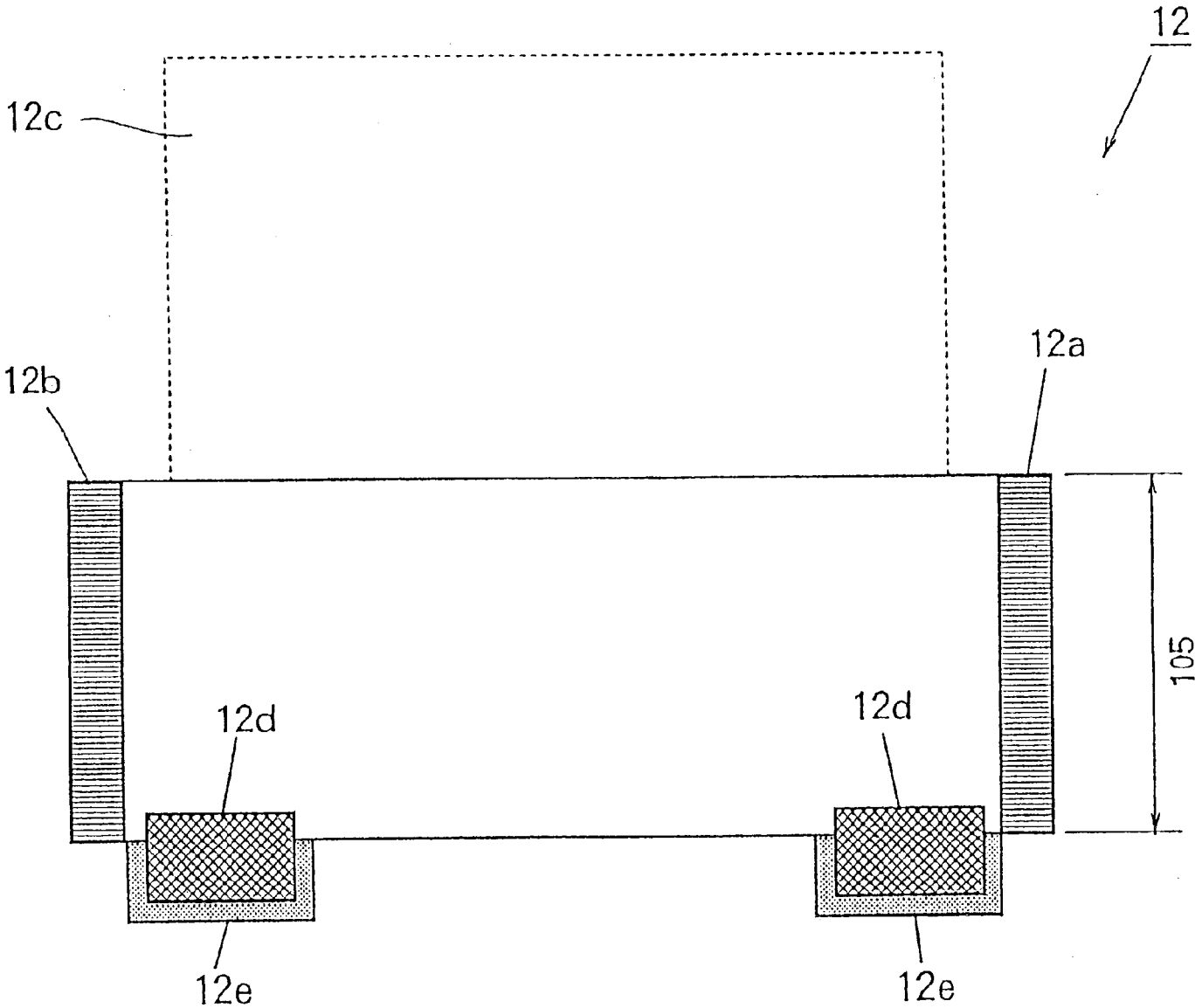
FIG. 2 is a schematic plan view showing an ASF section in FIG. 1.

Specifically, the ASF section 12 is constructed as shown in FIG. 2. FIG. 2 is a schematic plan view of the ASF section 12 shown in FIG. 1. That is, the ASF section 12 has a feed support section 12*c* provided so that the user easily places the dial-making jig 20, and two guides 12*a*, 12*b* for aligning both sides of the dial-making jig 20 when the dial-making jig 20 is placed on the ASF section 12.

In addition, the ASF section 12 includes two rollers 12*d*, 12*d*, and two guides 12*e*, 12*e* for feeding the dial-making jig 20 aligned by the guides 12*a*, 12*b* to the inside of the dial printing machine body 11. The guides 12*e*, 12*e* perform function of guide parts for the dial-making jig 20 being correctly fed to the inside of the dial printer body 11. The guides 12*e*, 12*e* are formed to have the length of, for example, about 105 mm as viewed from above.

Incidentally, the size of the dial printing machine body 11, not including the feed support section 12*c*, is for example, 199 mm long, 467 mm wide, and 296 mm deep, as shown in FIG. 1. This is the size of a so-called personal use-type printer used by an individual at home for private purposes.

Figure 3:
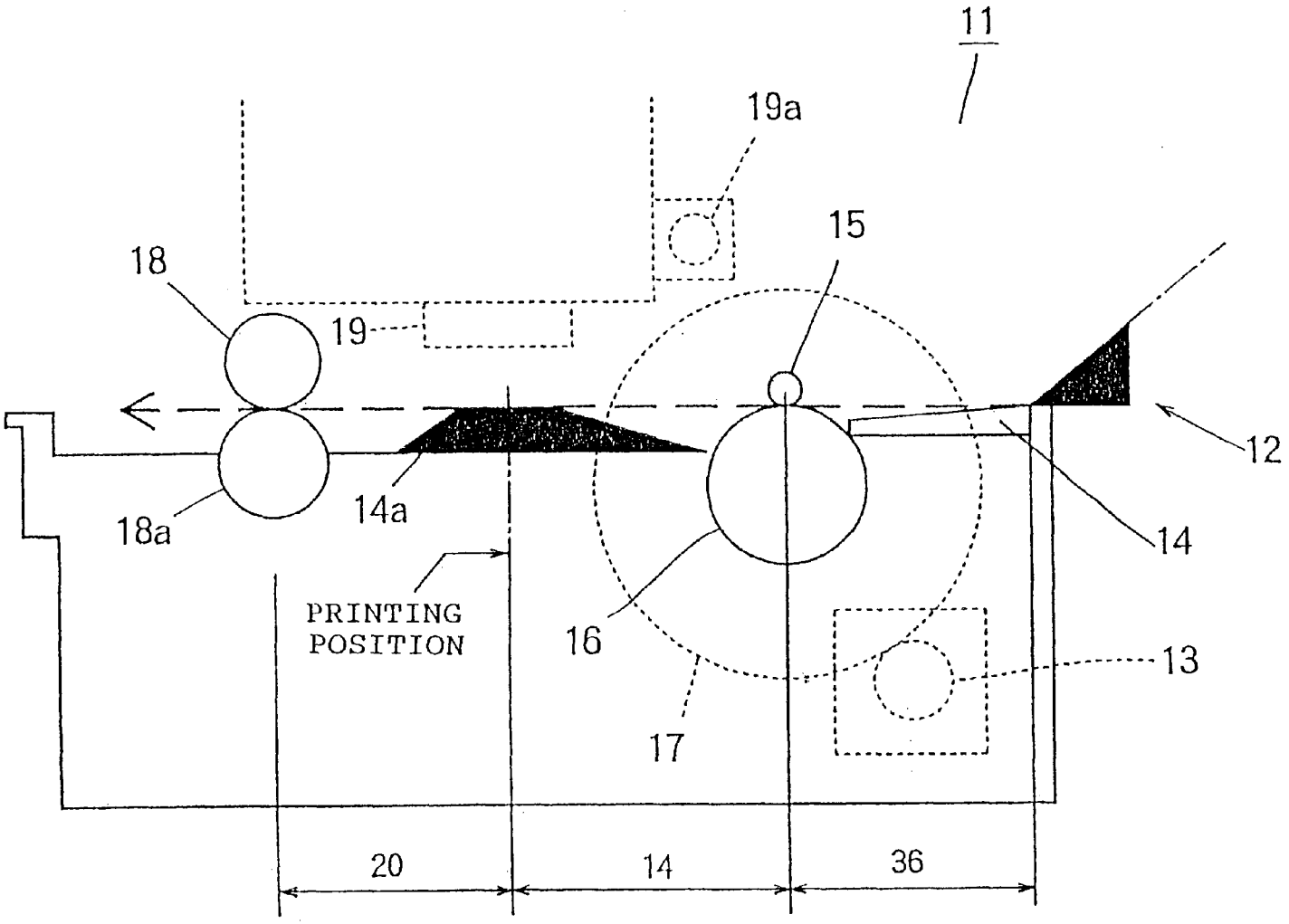
FIG. 3 is a schematic central sectional view showing a dial printing machine body in FIG. 1.

The inside of the dial printing machine body 11 is constructed as shown in FIG. 3. FIG. 3 is a central vertical sectional view of the dial printing machine body 11 in FIG. 1.

The arrow of a broken line shown in FIG. 3 shows a path on which the dial-making jig 20 moves in the dial printing machine body 11. In addition, as shown in FIG. 3, the dial printing machine body 11 is provided with a rear platen 14 for receiving the dial-making jig 20 fed from the ASF section 12 and for connecting the dial-making jig 20 to the feed roller 16. In addition, there are provided the feed roller 16 for receiving the dial-making jig 20 from the rear platen 14 and for feeding the dial-making jig 20 to a front platen 14*a*, which is at the printing position, a feed presser roller 15, and a driving gear 17. The dial-making jig 20 is pressed from above and below by the feed roller 16 and the feed presser roller 15, whereby the dial-making jig 20 can be precisely fed to the front platen 14*a*.

A printer head 19 is disposed above the front platen 14*a*, and ink, such as pigment, is ejected from a nozzle of the printer head 19, whereby a dial 30 of a time piece placed on the dial-making jig 20 is printed.

The printer head 19 is movably supported by a CR shaft 19*a* shown in FIG. 3.

The dial-making jig 20 having the printing-ended dial 30 is held by a serrated roller 18 and a discharge roller 18*a*, which is a discharge section shown in FIG. 3, and is discharged from the dial printer body 11.

Figure 4:
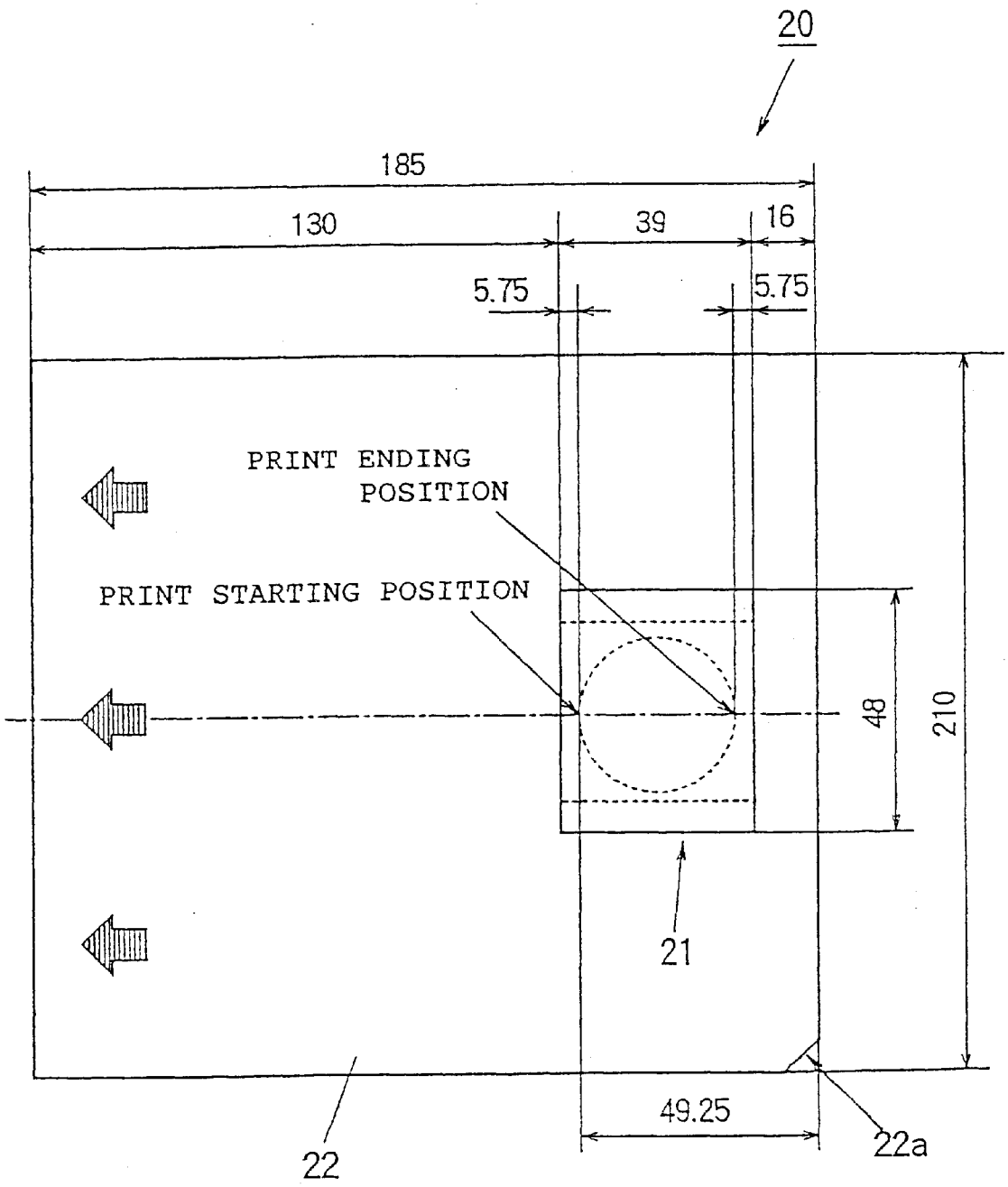
FIG. 4 is a schematic plan view showing a dial-making jig.

On the other hand, the dial-making jig 20 is constructed, for example, as shown in FIG. 4. As shown in FIG. 4, for example, a film 22, which is a printing position-determining member, is formed by cutting a bendable special purpose glossy film into, for example, a sheet of 210 mm long and 185 mm wide, and having a weight of, for example, about 6.85 g. In addition, as the film 22, a photo-print paper (manufactured by EPSON (registered trademark) Inc.), a photo-quality card (manufactured by EPSON (registered trademark) Inc.), a special purpose OHP sheet (manufactured by EPSON (registered trademark) Inc.), a superfine special purpose paper (manufactured by EPSON (registered trademark) Inc.), and a special purpose wood-free plain paper (manufactured by EPSON (registered trademark) Inc.) may be used instead of the special purpose glossy film. However, any material may be used as long as it can maintain environment resistance, abrasion resistance, and paper feed accuracy.

In addition, the film 22 is provided with three arrows for indicating the printing direction, as shown in FIG. 4. A cutout 22*a* showing a rear end part at the time of printing is provided in the lower right corner in the figure. For this reason, the user does not make a mistake in the printing direction by the three arrows and the cutout 22*a*.

The pallet 21, which is a placement member for material to be printed, is provided on the film 22. The pallet 21 is, for example, made of aluminum, and is formed in the size of, for example, 48 mm long and 39 mm wide, and the weight is, for example, 7.19 g. Specifically, the pallet 21 is as shown in FIG. 5.

Figure 5:
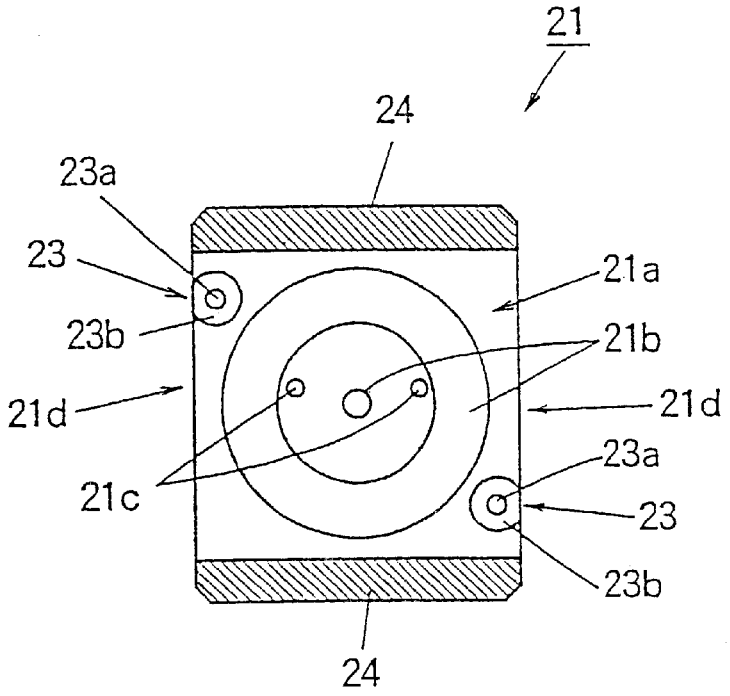
FIG. 5 is a schematic plan view showing a pallet 21 in FIG. 4.

As shown in FIG. 5, the pallet 21 is formed with a quadrangular work placement part 21*a* for placing the dial 30 of the timepiece , which is a material to be printed. In addition, the work placement part 21*a* has two work fixing parts 23, which are fixing parts, provided at the upper left and the lower right in the figure. The work fixing parts 23, 23 are provided with protrusions 23*a* at the centers thereof, respectively, and recesses 23*b* having a depth of 0.3 mm are formed therearound. The dial 30 of the timepiece is provided with depressions and projections 31, 31 (see FIG. 6) so as to correspond to the protrusion 23*a* and the recesses 23*b*. Therefore, by fitting the depressions and projections 31, 31 of the dial 30 to be printed into the protrusions 23*a* and the recesses 23*b* of the work fixing part 23, the dial 30 of the timepiece is fixed to the pallet 21.

In this case, when the dial 30 of the timepiece is insufficiently fixed, fixing side edges 24, 24, which are fixing parts provided at upper and lower ends of the pallet 21 in FIG. 5, are used.

Figure 6:
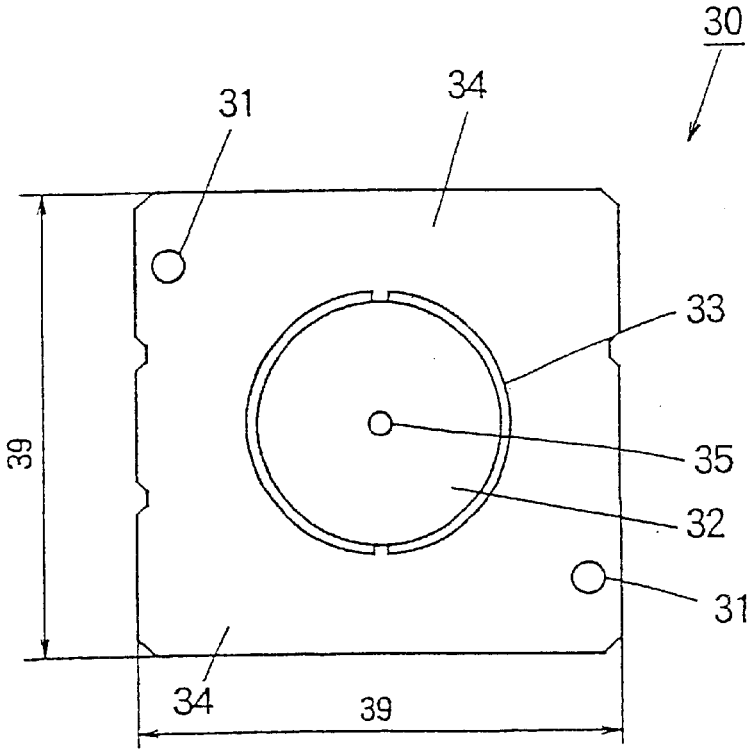
FIG. 6 is a schematic plan view of a dial of a timepiece.

Incidentally, as shown in FIG. 6, a dial body 32 incorporated into the timepiece is arranged in the center of the dial 30 of the timepiece, and a press-punched groove 33 is provided on the peripheral part thereof. And, quadrangular frames 34 for supporting the dial body 32 are disposed on the outside the thereof.

When printing is performed on the dial body 32, printing is performed in a state where the frames 34 are attached to the dial 30, and the frames 34 are removed after the completion of printing, and the dial body is attached to the timepiece.

Therefore, when printing is performed by the dial printer 10, the dial 30 of the timepiece to which the frame 34 is attached is placed on the work placement part 21*a* of the pallet 21 shown in FIG. 5.

For this reason, the upper and lower ends in the figure of the frame 34 of the dial 30 of the timepiece are placed on the portions of broken lines in FIG. 5. And, in this state, by fixing the frames 34, 34 to the fixing side edges 24, 24, which are the fixing parts provided on the upper and lower end parts of the pallet 21 in FIG. 5, with, for example, an adhesive tape, the dial 30 of the timepiece can be fixed to the pallet 21 more firmly.

In addition, the pallet 21 is provided with two holes 21*c* for the pins, as shown in FIG. 5. The holes 21*c*, 21*c* for pins are provided corresponding to mounting pins formed on the reverse face of the dial 30 of the timepiece shown in FIG. 6. Since each mounting pin has a height of 1.3 mm to 1.6 mm, the holes 21*c*, 21*c* are formed so that they can accommodate the mounting pins having the height. In addition, in order to accommodate the mounting pins, the thickness of the pallet 21 is about 1.7 mm.

Incidentally, an ink-collecting part 21*b* having a diameter of 3 mm, and a depth of 0.3 mm is provided in the center of the work placement part 21*a* of the pallet 21. In addition, an ink-collecting part 21*b* having a depth of 0.3 mm is provided in the outer peripheral part of the ink-collecting part 21*b*.

These ink-collecting parts 21*b*, 21*b* are provided for the following reasons. That is, as shown in FIG. 6, the dial 30 of the timepiece is provided with a circular hole 35 for passing a shaft of an hour hand or the like through the center of the dial body 32. In addition, the press-punched groove 33 is also provided as described above. For this reason, when printing is performed with the dial printer 10, the ink may leak from the hole 35 and the groove 33 to enter in between the dial 30 of the timepiece and the pallet 21.

In order to prevent such ink leakage, the ink-collecting parts 21*b* are provided at portions of the pallet 21 corresponding to the hole 35 and the groove 35 from which the ink may leak.

In this case, when, for example, an absorbing sheet, which is a member for absorbing the ink, is arranged between the dial 30 of the timepiece and the pallet 21, the absorbing sheet absorbs the leaked ink, so that the ink leakage can be prevented more effectively.

In addition, the pallet 21 is provided with two detaching recesses 21*d* on both sides thereof, as shown in FIG. 5. The detaching recesses 21*d*, 21*d* serve as finger-hooking parts when the user detaches the dial 30 of the timepiece from the pallet 21. Therefore, the detaching recesses 21*d*, 21*d* are formed to be 0.5 mm deep and 14 mm wide. That is, the width is set in consideration of the width of the finger of a user.

The pallet 21 is constructed as described above, and the dial 30 of the timepiece is placed and fixed thereon as described above.

The dial printing machine 10 according to this embodiment is constructed as described above. The operation and the like of the dial printing machine 10 will be described below. In addition, the positional relationship between the pallet 21 of the dial-making jig 20 and the film 22 will be also described while describing the operation and the like.

Figure 7:
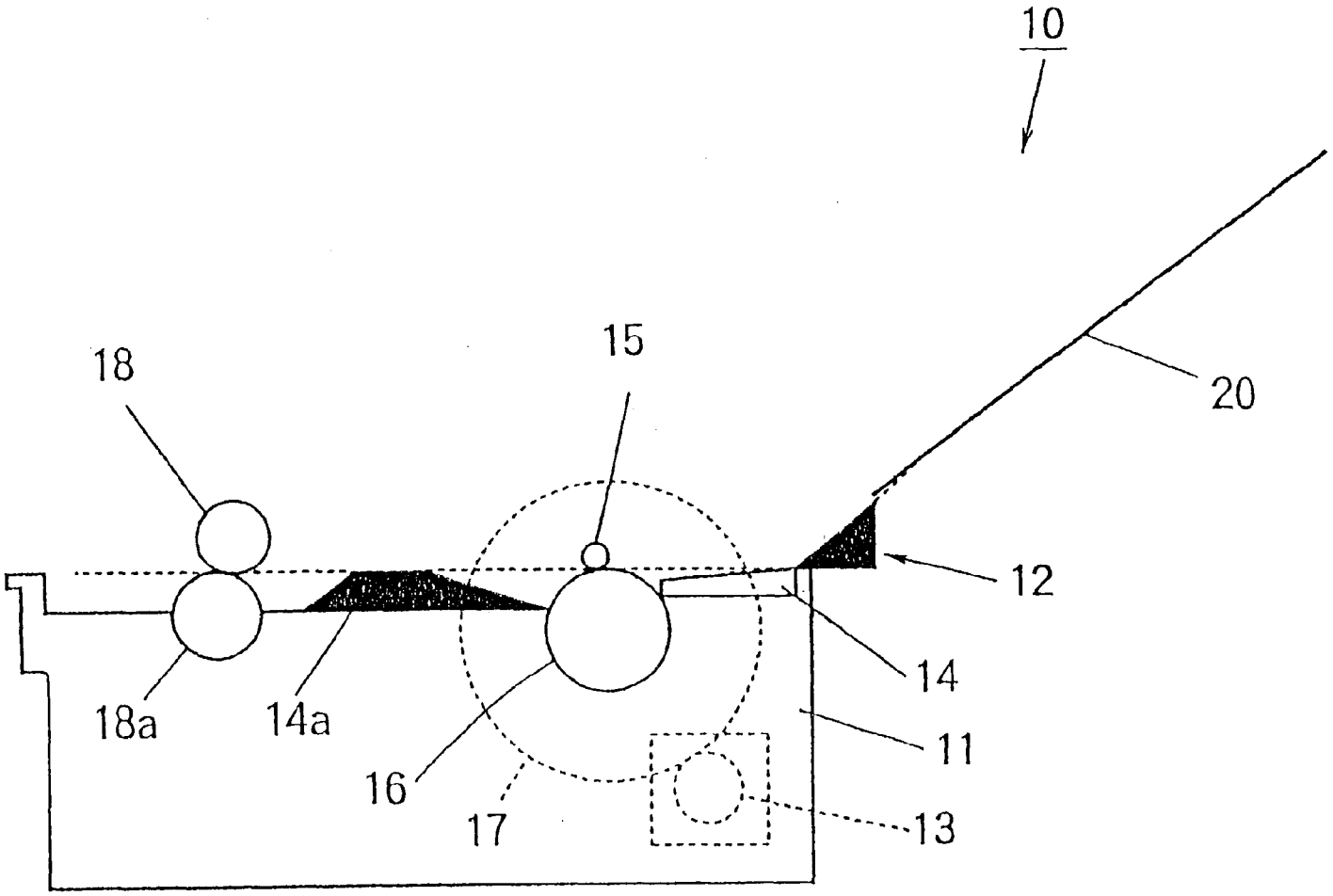
FIG. 7 is a schematic sectional view showing the state where the dial-making jig is set to the ASF section of the dial printing machine.

First, in order to print a predetermined pattern or the like on the dial 30 of the timepiece, the user places and fixes the dial 30 of the timepiece on the pallet 21 of the dial-making jig 20, as described above. Thereafter, the dial-making jig 20 is set to the ASF section 12 of the dial printing machine 10. FIG. 7 shows this state.

Figure 8:
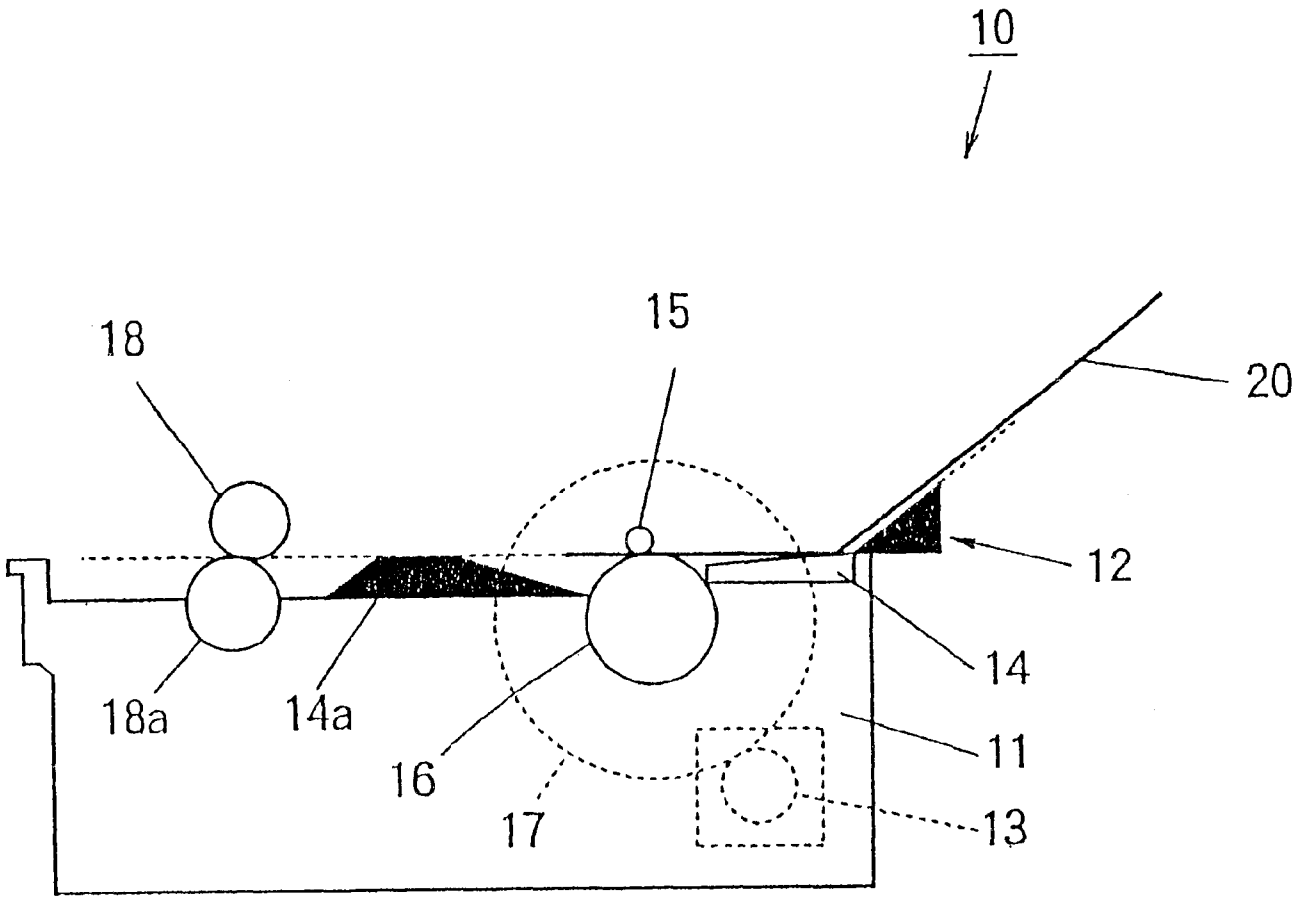
FIG. 8 is a schematic sectional view showing the state where the dial-making jig is guided to the inside of the dial printing machine body by rollers of the ASF section.

Next, the user switches on the dial printing machine 10, and the dial-making jig 20 is guided to the inside of the dial printing machine body 11 by the roller 12*d* of the ASF section 12. FIG. 8 shows this state.

In FIG. 8, when the dial-making jig 20 is guided to the inside of the dial printing machine body 11, since the rollers 12*d*, 12*d* are located on both sides of the ASF section 12, the rollers 12*d*, 12*d* do not abut against the pallet 21 disposed in the center of the dial-making jig 20.

That is, as shown in FIG. 4, since the pallet 21 is disposed at the central part of the forward direction of the dial-making jig 20, the rollers 12*d*, 12*d* of the ASF section 12 are provided so as to avoid the pallet 21 (see FIG. 2). For this reason, the rollers 12*d*, 12*d* abut against only the film 22 in FIG. 4.

In addition, although the film 22 of the dial-making jig 20 is bent in FIG. 8, the pallet 21 and the dial 30 of the timepiece placed on the pallet 21 is guided to the inside of the dial printing machine body 11 without being bent.

Incidentally, in FIG. 8, a part of the dial-making jig 20 reaches the feed roller 16 and the feed presser roller 15.

Figure 9:
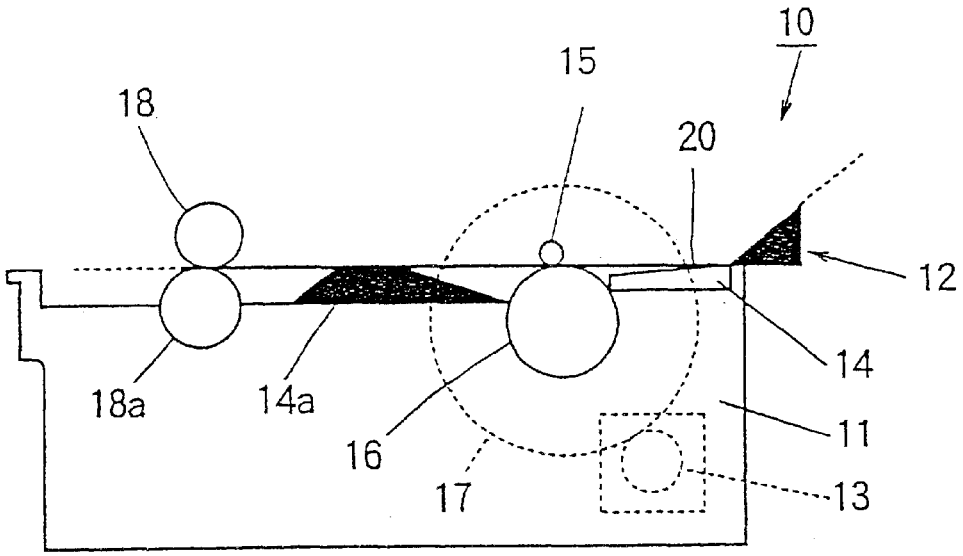
FIG. 9 is a schematic sectional view showing the state where the dial-making jig is further pulled in by a feed roller and a feed presser roller to reach a print starting position.

Thereafter, the dial-making jig 20 is further pulled in by the feed roller 16 and the feed presser roller 15 to reach a print starting position. FIG. 9 shows this state. As shown in FIG. 9, a front end part of the dial-making jig 20 reaches the serrated roller 18 and the discharge roller 18*a*, and the central part thereof is supported by the front platen 14*a*, the feed presser roller 15, and the feed roller 16. Furthermore, a rear end part thereof passes through the ASF section 12, and is supported by the rear platen 14. In this way, it is important that the dial-making jig 20 is placed almost horizontally in the dial printing machine body 11. That is, when a part of the rear end part of the dial-making jig 20 is left in the ASF section 12, an angle is formed between the dial-making jig 20 and the printer head 19 of the dial printer 10, and since the angle is simultaneously formed between the pallet 21 and printer head 19 and between the dial 30 of the timepiece and the printer head 19, correct printing cannot be performed.

Therefore, it is necessary to adjust the positional relationship between the pallet 21 and the film 22 in the state where the dial-making jig 20 is located at the position shown in FIG. 9.

As shown in FIG. 4, the length from the print starting on the pallet 21 to the right end of the film 22 is 49.25 mm. This is intended to start printing when the right end of the film 22 passes through the ASF section 12 and reaches the rear platen 14. That is, this is due to the fact that the length from the right end of the rear platen 14 to the printing position of the front platen 14*a* is 50 mm, as shown in FIG. 3.

In addition, as shown in FIG. 9, in consideration of the fact that the dial-making jig 20 has reached the discharge roller 18*a* at the time of start of printing, and the height and operability of the ASF section 12, the length between the left end of the film 22 and the left end of the pallet 21 is set to 130 mm.

Incidentally, when the dial-making jig 20 is set to the printing position, ink is ejected by the printer head 19 of the dial printing machine 10, as described above, and printing of a predetermined pattern or the like is started. The dial-making jig 20 moves, and printing by the printer head 19 is continued to a print ending position shown in FIG. 4.

In this case, even if the ink leaks from the groove 33 of the dial 30 of the timepiece, the ink is collected in ink-collecting parts 21*b*, 21*b*, of the pallet 21, as described above, so that the ink does not enter in between the dial 30 of the timepiece and the pallet 21.

Figure 10:
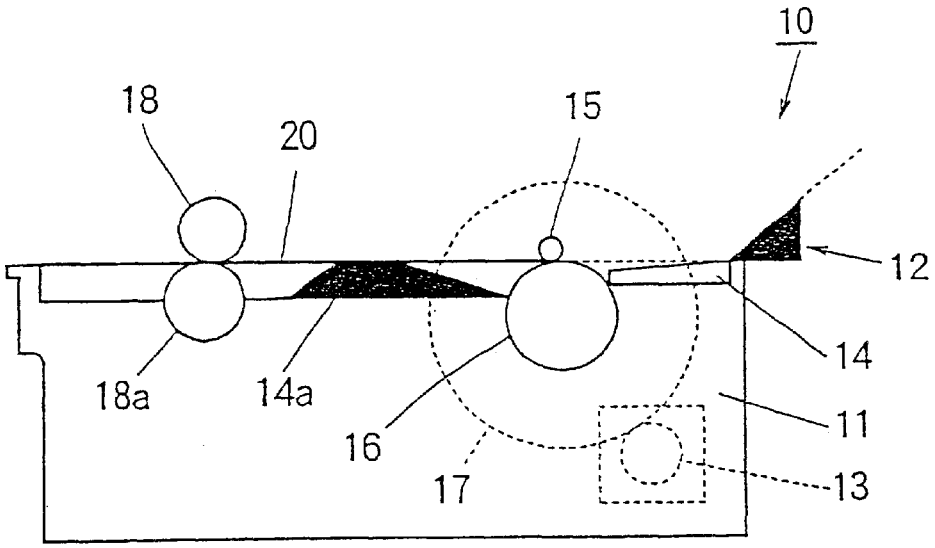

When printing is completed, the dial-making jig 20 is moved by the discharge roller 18*a* and the like in the discharge direction, as shown in FIG. 10. FIG. 10 shows the state of this time. Even at the time of completion of printing, it is necessary that the dial-making jig 20 abut against the feed roller 16 and the discharge roller 18*a*. For this reason, the length between the print ending position of the pallet 21 and the film 22 is 21.75 mm, as shown in FIG. 4. This is because the length between the printing position and the feed roller 16 is 14 mm, as shown in FIG. 3.

By operating the dial printer 10 according to this embodiment as described above, even a material, for example, the dial 30 of the timepiece which is relatively small, hard and thick, unlike a paper, can be printed merely by the preparation of the dial-making jig 20, without preparing a special printer. Therefore, a retail timepiece store or an individual can easily show a favorite pattern and the like on the dial 30 of the timepiece simply by preparing a regular printer device, and the dial-making jig 20.

Incidentally, the dial-making jig 20 used in the dial printing machine 10 according to this embodiment is assembled as follows.

Figure 11:
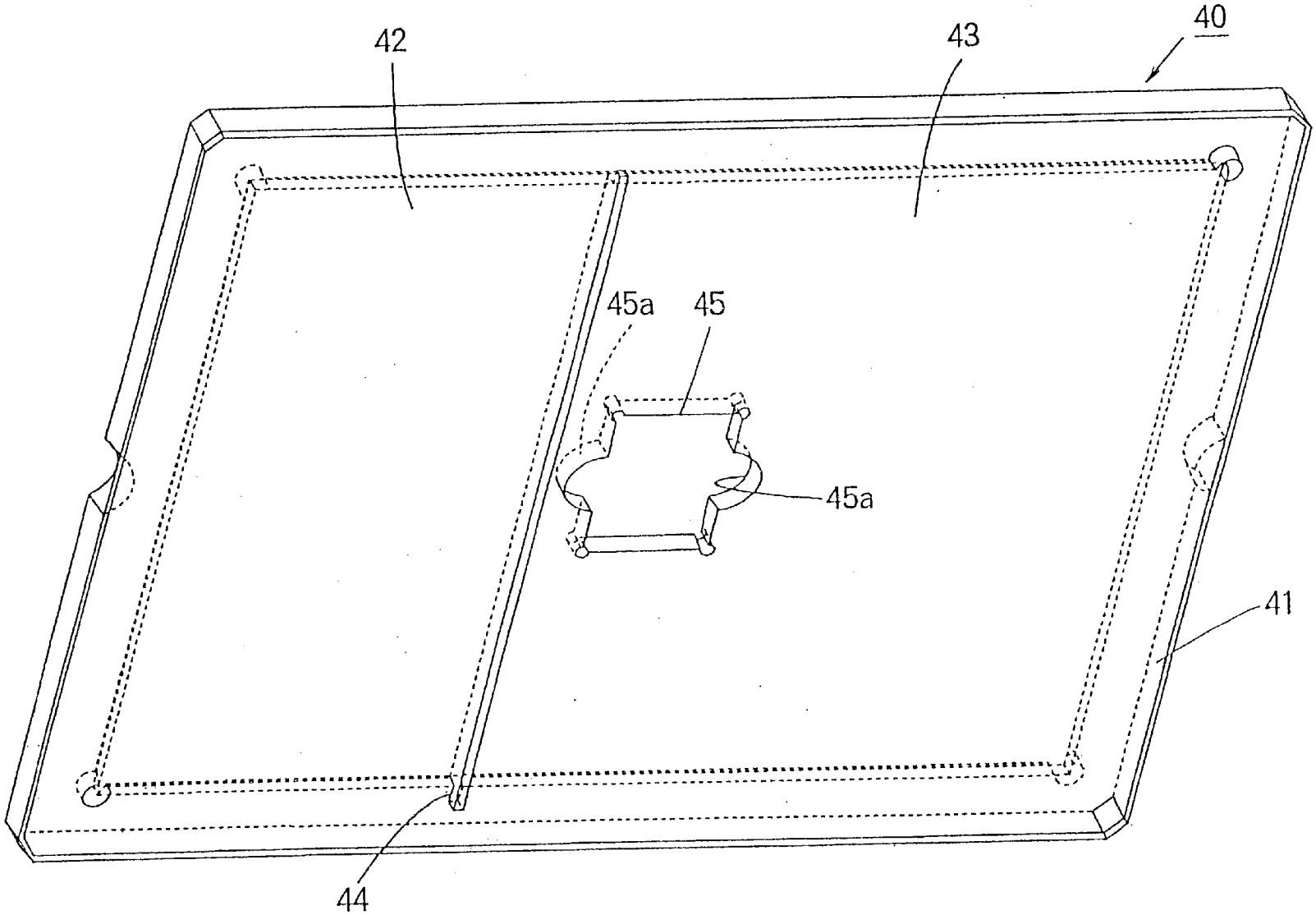
FIG. 11 is a schematic perspective view showing an assembly jig of the dialmaking jig according to the embodiment.
Figure 12:
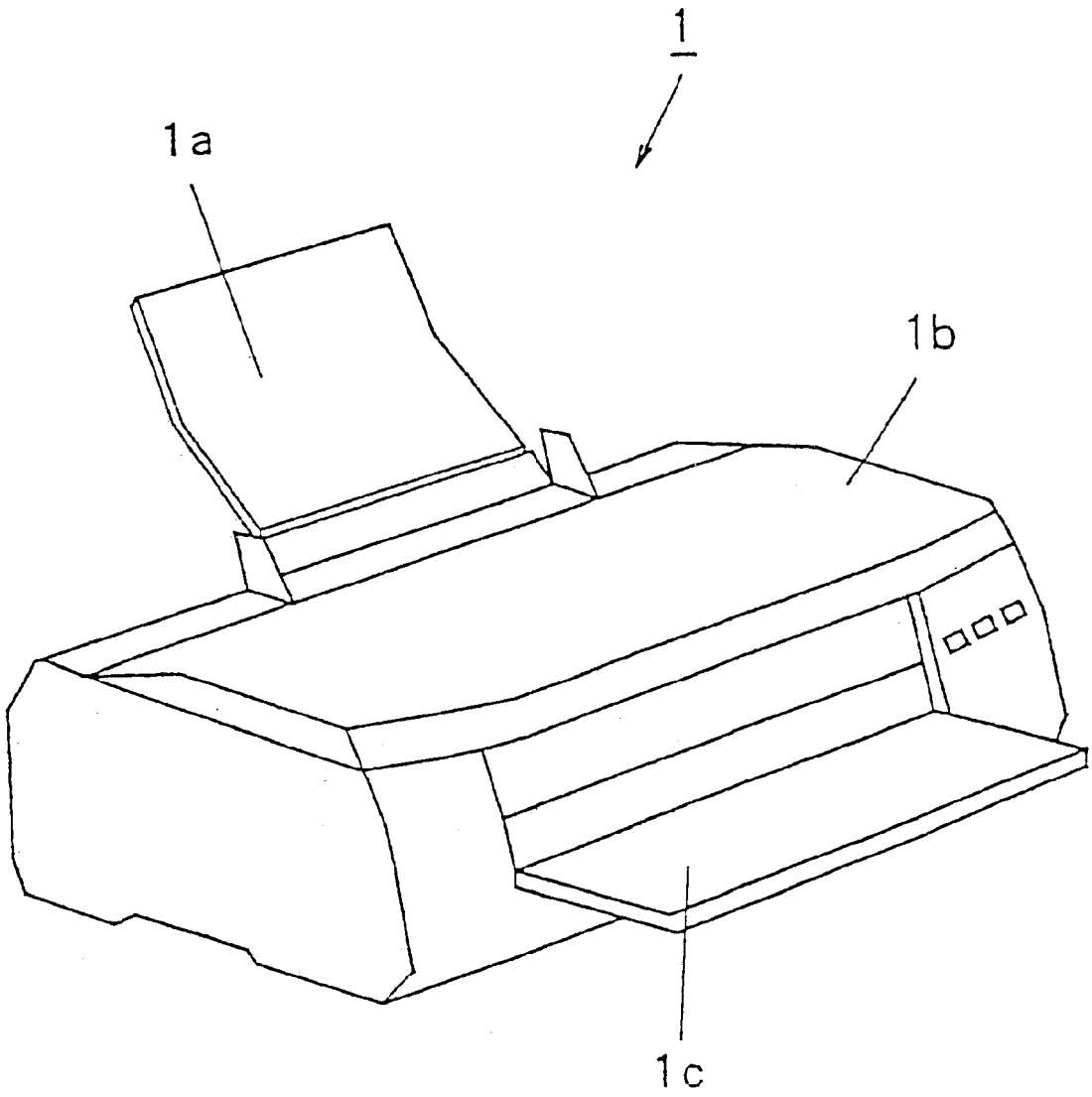
FIG. 12 is a schematic perspective view showing a conventional printer device.

That is, since the positional relationship between the pallet 21 forming the dial-making jig 20 and the film 22 are defined in precise detail, as described above, an assembly jig 40 of a dial-making jig, which is an assembly jig for the printing aid, is provided, as shown in FIG. 11, so that the positional relationship can be set easily with a simple configuration.

As shown in FIG. 11, the assembly jig 40 of the dial-making jig according to this embodiment includes a film storage section 41 serving as a storage section for storing the film 22, which is a printing position-determining member, and a first cover 42 and a second cover 43 placed on the film 22 from above. In addition, a cutting section 44, which is a working section, is provided between the first cover 42 and the second cover 43. Incidentally, a portion formed by the second cover 43 is 210 mm long and 185 mm wide, which is the size of the film 22 shown in FIG. 4.

Furthermore, the second cover 43 is provided with a pallet insertion hole 45, which is a mounting opening. In addition, the pallet insertion hole 45 is provided with setting recesses 45*a*, 45*a* so that a holder (not shown) for holding the pallet 21 can be set on the film 22 in a state of holding the pallet 21.

The assembly jig 40 of the dial-making jig according to this embodiment is constructed as described above. A method of use thereof will be described below.

First, the user stores the film 22 in the film storage section 41. Thereafter, the first cover 42 and the second cover 43 are placed on the film 22. Furthermore, a bonding agent, for example, a spray paste, is applied on the pallet 21, and the pallet 21 is inserted from the pallet insertion hole 45 while the pallet 21 is being picked up and fingers of the use are inserted into the setting recesses 45*a* and 45*a*. Then, the pallet 21 is brought into abutment with the film 22. This allows the pallet 21 to be bonded to the film 22 by the bonding agent. Thereafter, the film 22 is cut by the cutting section 44, whereby the dial-making jig 20 shown in FIG. 4 is assembled.

In this case, since the pallet insertion hole 45 is positioned so that the pallet 21 is correctly placed on the position shown in FIG. 4, the positions of the pallet 21 of the assembled dial-making jig 20 and the film 22 are as shown in FIG. 4. This also applies to a case where pluralities of dial-making jigs 20 are assembled.

Therefore, if the assembly jig 40 of the dial-making jig is used, the dial-making jig 20 provided with the pallet 21 at the optimal position can be easily assembled.

While a dial of a timepiece is used as a material to be printed in this embodiment, the material is not limited thereto, and it is apparent that the present invention can be applied to other three-dimensional objects, for example, a card, a name badge, a pin badge, a pendant, a locket, a broach, a button, a medal, and the like.

What is claimed is:

1. A printing aid, comprising:

a printing position-determining member for determining a printing position of a non-flexible material relative to a recording device for printing on the non-flexible material; and a placement member for placing the non-flexible material to be printed at a location on the printing position-determining member corresponding to the printing position determined by the printing position-determining member;

wherein the placement member includes a central area for accommodating the non-flexible material, a first ink-collecting area positioned in the approximate center of the central area and a second ink-collecting area positioned on the outer periphery of the central area.

2. A printing aid as claimed in claim 1, wherein the printing position-determining member is formed of a base material having flexibility.

3. A printing aid as claimed in claim 1, wherein the printing position-determining member is provided with a printing direction-indicating part for indicating a printing direction.

4. A printing aid as claimed in claim 3, wherein the printing direction-indicating part is formed by at least one of an arrow and a cutout.

5. A printing aid as claimed in claim 1, wherein the material to be printed forms a dial of a timepiece, the dial of the timepiece is provided with a mounting pin, and the placement member for material to be printed is formed with a hole for receiving the pin.

6. A printing aid as claimed in claim 1, wherein the placement member for material to be printed is provided with a fixing part for fixing the material to be printed.

7. A printing aid as claimed in claim 1, wherein the placement member for material to be printed is provided with an ink-collecting part for collecting ink ejected from the recording device.

8. A printing aid as claimed in claim 1, wherein the placement member for material to be printed is formed with a member for absorbing ink ejected from the recording device.

9. A printing aid as claimed in claim 1, wherein the placement member for material to be printed is provided with a detaching recess for detaching the material to be printed.

10. An assembly jig for a printing aid, comprising:

a storage section for storing a printing position-determining member, said storage section having a first opening for receiving the print position-determining member;

a processing section for processing the printing position-determining member into a required size; and wherein said storage section includes a second opening for mounting a placement member for material to be printed having the material to be printed placed thereon at a predetermined position of the printing position-determining member.

11. An assembly jig for a printing aid as claimed in claim 10, wherein the mounting opening is provided with a setting recess which corresponds to a holder for holding the placement member for material to be printed and sets up the placement member for material to be printed on the printing position-determining member.

12. A recording device, comprising:

a recording device body;

a feed section for pulling in an object to a printing position in the recording device body; and a discharge section for discharging the object from the recording device body;

wherein the object is a printing aid having a printing position-determining member for determining a printing position of a non-flexible material relative to the recording device for printing on the non-flexible material; and a placement member for placing the non-flexible material to be printed at a location on the printing position-determining member corresponding to the printing position determined by the printing position-determining member;

wherein the placement member includes a central area for accommodating the non-flexible material, a first ink-collecting area positioned in the approximate center of the central area and a second ink-collecting area positioned on the outer periphery of the central area.

13. An assembly jig for a printing aid, comprising:

a printing position-determining member that defines a printing area and that is adapted to be transported or positioned inside of a printer;

a storage section in which the printing position-determining member is contained, the storage section having a mounting opening corresponding to the printing area; and a non-flexible placement member provided on the printing position-determining member at a position corresponding to the printing area, the non-flexible placement member being constructed to receive an object to be printed.

14. The assembly jig of claim 13, further comprising:

a processing section for forming the printing position-determining member into a specified size.

15. The assembly jig of claim 13, wherein the mounting opening has at least one setting recess to facilitate the setting of the placement member on the printing position-determining member.

16. The assembly jig of claim 13, wherein the printing position-determining member comprises a flexible film.

17. The assembly jig of claim 13, wherein the placement member comprises a pallet.

18. The assembly jig of claim 13, wherein the printing position-determining member includes a printing direction indicator comprised of at least one of an arrow and a cutout.

19. The assembly jig of claim 13, wherein the placement member is formed with at least one aperture, each of which is adapted to receive a mounting pin on an object to be printed.

20. The assembly jig of claim 13, wherein the placement member includes a fixing part for fixing an object to be printed thereon.

21. The assembly jig of claim 13, wherein the placement member is made of aluminum.

* * * * *